US009062363B2

(12) United States Patent
Hara et al.

(10) Patent No.: US 9,062,363 B2
(45) Date of Patent: Jun. 23, 2015

(54) METHOD OF PRODUCTION OF HOT COIL FOR LINE PIPE

(71) Applicant: Nippon Steel & Sumitomo Metal Corporation, Tokyo (JP)

(72) Inventors: Takuya Hara, Tokyo (JP); Takeshi Kinoshita, Tokyo (JP); Kazuaki Tanaka, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/236,957

(22) PCT Filed: Sep. 27, 2012

(86) PCT No.: PCT/JP2012/074969
§ 371 (c)(1),
(2) Date: Feb. 4, 2014

(87) PCT Pub. No.: WO2013/047702
PCT Pub. Date: Apr. 4, 2013

(65) Prior Publication Data

US 2014/0190597 A1 Jul. 10, 2014

(30) Foreign Application Priority Data

Sep. 27, 2011 (JP) ..... 2011-210746
Sep. 27, 2011 (JP) ..... 2011-210747

(51) Int. Cl.
*C21D 9/08* (2006.01)
*C21D 8/10* (2006.01)
(Continued)

(52) U.S. Cl.
CPC ..... *C22C 38/58* (2013.01); *C21D 8/0263* (2013.01); *C21D 9/46* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01);
(Continued)

(58) Field of Classification Search
None
See application file for complete search history.

(56) References Cited

U.S. PATENT DOCUMENTS

2010/0258219 A1* 10/2010 Ahn et al. ..... 148/645

FOREIGN PATENT DOCUMENTS

JP 09-031544 2/1997
JP 2000-313920 11/2000
(Continued)

OTHER PUBLICATIONS

International Search Report dated Dec. 18, 2012, issued in corresponding PCT Application No. PCT/JP2012/074969 [With English Translation].

*Primary Examiner* — Deborah Yee
(74) *Attorney, Agent, or Firm* — Kenyon & Kenyon LLP

(57) ABSTRACT

The present invention provides a hot coil for line pipe use which can reduce deviation in ordinary temperature strength and improve low temperature toughness despite the numerous restrictions in production conditions due to the coiling step and provides a method of production of the same, specifically makes the steel plate stop for a predetermined time between rolling passes in the recrystallization temperature range and performs cooling by two stages after hot rolling so as to thereby make the steel structure at the center part of plate thickness and effective crystal grain size of 3 to 10 μm, make the total of the area ratios of bainite and acicular ferrite 60 to 99%, and make the absolute value of A-B 0 to 30% when the totals of the area ratios of bainite and acicular ferrite at any two portions are designated as respectively A and B.

5 Claims, 2 Drawing Sheets

(51) Int. Cl.

| | |
|---|---|
| ***C22C 38/58*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.

CPC ..... *C22C 38/14* (2013.01); *C22C 38/16* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C22C 38/44* (2013.01); *C22C 38/46* (2013.01); *C22C 38/48* (2013.01); *C22C 38/50* (2013.01); *C22C 38/54* (2013.01)

(56) References Cited

FOREIGN PATENT DOCUMENTS

| | | |
|---|---|---|
| JP | 2007-138290 | 6/2007 |
| JP | 2008-163456 | 7/2008 |
| JP | 2008-248384 | 10/2008 |
| JP | 2010-174342 | 8/2010 |
| JP | 2010-174343 | 8/2010 |
| JP | 2010-196155 | 9/2010 |
| JP | 2010-196156 | 9/2010 |
| JP | 2010-196157 | 9/2010 |
| JP | 2010-196160 | 9/2010 |
| JP | 2010-196161 | 9/2010 |
| JP | 2010-196163 | 9/2010 |
| JP | 2010-196164 | 9/2010 |
| JP | 2010-196165 | 9/2010 |
| JP | 2011-195883 | 10/2011 |
| WO | 2010/052926 | 5/2010 |

* cited by examiner

METHOD OF PRODUCTION OF HOT COIL FOR LINE PIPE

This application is a national stage application of International Application No. PCT/JP2012/074969, filed Sep. 27, 2012, which claims priority to Japanese Application Nos. 2011-210746, filed Sep. 27, 2011, and 2011-210747, filed Sep. 27, 2011, the contents of which are incorporated by reference in their entirety.

TECHNICAL FIELD

The present invention relates to a hot coil for line pipe use and a method of production of the same, more particularly relates to a hot coil which is suitable for use for line pipe for the transport of natural gas and crude oil and to a method of production of the same.

BACKGROUND ART

In recent years, the importance of pipelines as a method for long distance transport of crude oil, natural gas, etc. has been increasingly rising. Further, 1) to improve the transport efficiency by raising the pressure and (2) to improve the field installation ability by reducing the outside diameter and weight of line pipe, line pipe which has higher strength is being used in increasing instances. At the present, high strength line pipes of up to the American Petroleum Institute (API) standard X120 (tensile strength 915 MPa or more) have been put into practice. These high strength line pipes are generally produced by the UOE method, bending roll method, JCOE method, etc.

However, for trunk line pipe for long distance transport use, line pipe corresponding to the API standard X60 to X70 continues to be used in large numbers. As line pipe corresponding to the X60 to X70, much spiral steel pipe and electric resistance welded steel pipe with their high field installabilities are being used.

As the material which is used for the production of line pipe, when using the UOE method, bending roll method, or JCOE method to produce the line pipe, hot rolled steel plate which is not wound in a coil shape is used. On the other hand, when producing spiral steel pipe or electric resistance welded steel pipe, hot rolled steel plate which has been wound in a coil shape is used. Here, hot rolled steel plate which is not wound in a coil shape will be referred to as "plate" while hot rolled steel plate which is wound in a coil shape will be referred to as a "hot coil".

PLT's 1 to 10 describe hot coils which are used for the production of spiral steel pipe or electric resistance welded steel pipe. Further, PLT's 11 to 14 describe plates which are used when using the UOE method, bending roll method, or JCOE method to produce line pipe.

Line pipe which transports crude oil, natural gas, or other flammable material require reliability at ordinary temperature of course and also reliability at low temperatures since it is used even in arctic regions. Therefore, the plate and hot coil which serve as materials for thick line pipe are required to be reduced in variation of ordinary temperature strength and to be improved in low temperature toughness.

The plates which are described in PLT's 11 to 14, since there is no coiling step, are large in freedom of conditions for cooling the steel plate after hot rolling and can give stable, uniform steel structures. Further, since there is no coiling step, sufficient time can be taken for holding the steel plates at the recrystallization temperature range between the rough rolling and finish rolling, so from this as well, the desired steel structure can be stably obtained. As a result, the plates which are described in PLT's 11 to 14 are small in deviation in ordinary temperature strength and excellent in low temperature toughness as well.

On the other hand, the hot coils which are described in PLT's 1 to 10 are not sufficiently reduced in deviation in ordinary temperature strength and are not sufficiently improved in low temperature toughness either. PLT's 1 to 10 describe cooling methods for steel plate after hot rolling so as to reduce the deviation in strength of the hot coils and improve the low temperature toughness. In particular, PLT's 1 to 2 and 6 to 9 describe cooling steel plate after hot rolling in multiple stages. However, in the production of a hot coil, there is a coiling step and the rough rolling and finish rolling are performed consecutively, so the restrictions on the production conditions become greater. Therefore, with just the improvements of the cooling method which are described in PLT's 1 to 10, the desired steel structure was not obtained and it was difficult to obtain hot coil with little deviation in ordinary temperature strength and excellent in low temperature toughness.

CITATIONS LIST

Patent Literature

PLT 1: Japanese Patent Publication No. 2010-174342A
PLT 2: Japanese Patent Publication No. 2010-174343A
PLT 3: Japanese Patent Publication No. 2010-196155A
PLT 4: Japanese Patent Publication No. 2010-196156A
PLT 5: Japanese Patent Publication No. 2010-196157A
PLT 6: Japanese Patent Publication No. 2010-196160A
PLT 7: Japanese Patent Publication No. 2010-196161A
PLT 8: Japanese Patent Publication No. 2010-196163A
PLT 9: Japanese Patent Publication No. 2010-196164A
PLT 10: Japanese Patent Publication No. 2010-196165A
PLT 11: Japanese Patent Publication No. 2011-195883A
PLT 12: Japanese Patent Publication No. 2008-248384A
PLT 13: WO2010/052926A
PLT 14: Japanese Patent Publication No. 2008-163456A

SUMMARY OF INVENTION

Technical Problem

The present invention has as its object to provide a hot coil for line pipe use which can reduce deviation in ordinary temperature strength and improve low temperature toughness despite the numerous restrictions in production conditions due to the coiling step and to provide a method of production of the same. Note that, the "ordinary temperature strength" means the tensile strength (TS), yield strength, yield to tensile ratio, and hardness at ordinary temperature.

Solution to Problem

The inventors engaged in in-depth research and obtained the following findings:

a) To reduce the deviation in ordinary temperature strength, the effective crystal grain size of the steel plate which forms the hot coil has to be made 10 μm or less, then the matrix structure has to be made uniform in the thickness direction and the longitudinal direction. That is, it is insufficient if, like in the past, the matrix structure of the steel plate which forms the hot coil is only made uniform in the thickness direction and longitudinal direction.

b) If making the effective crystal grain size of the steel structure 10 μm or less, then making the total of the bainite and the acicular ferrite of the matrix structure an area ratio of a predetermined value or more, the low temperature toughness is also improved.

c) To make the effective crystal grain size of the steel structure 10 μm or less, it is necessary to cause sufficient recrystallization by the rough rolling in the hot rolling. For this reason, in the production of a hot coil with a coiling step, it is necessary to make the steel plate in the middle of the hot rolling stop for a predetermined time at least once between rolling passes in the recrystallization temperature range.

d) To make the matrix structure uniform in the thickness direction and the longitudinal direction, it is necessary to cool the steel plate after the hot rolling in multiple stages.

e) To reduce the variation in ordinary temperature strength, it is necessary to make the effective crystal grain size of the steel structure a predetermined value or less and to make the matrix structure uniform in the thickness direction and the longitudinal direction. Therefore, just the two-stage cooling like in the past is insufficient. Both two-stage cooling and stopping the steel plate in the middle of hot rolling between the rolling passes in the recrystallization temperature range are necessary.

The present invention was made based on the above discoveries and has as its gist the following:

(1) Hot coil for line pipe use which has a chemical composition which contains, by mass %,
C: 0.03 to 0.10%,
Si: 0.01 to 0.50%,
Mn: 0.5 to 2.5%,
P: 0.001 to 0.03%,
S: 0.0001 to 0.0030%,
Nb: 0.0001 to 0.2%,
Al: 0.0001 to 0.05%,
Ti: 0.0001 to 0.030% and
B: 0.0001 to 0.0005%
and has a balance of iron and unavoidable impurities, which has a steel structure at a center of plate thickness with an effective crystal grain size of 2 to 10 μm, which has a total of the area ratios of bainite and acicular ferrite of 60 to 99%, which has an absolute value of A-B of 0 to 30% when designating the totals of the area ratios of bainite and acicular ferrite at any two portions as respectively A and B, which has a plate thickness of 7 to 25 mm, and which has a tensile strength TS in the width direction of 400 to 700 MPa.

(2) The hot coil for line pipe use as set forth in the above (1), characterized in that the hot coil further contains, by mass %, one or more of
Cu: 0.01 to 0.5%,
Ni: 0.01 to 1.0%,
Cr: 0.01 to 1.0%,
Mo: 0.01 to 1.0%,
V: 0.001 to 0.10%,
W: 0.0001 to 0.5%,
Zr: 0.0001 to 0.050%
Ta: 0.0001 to 0.050%
Mg: 0.0001 to 0.010%,
Ca: 0.0001 to 0.005%,
REM: 0.0001 to 0.005%,
Y: 0.0001 to 0.005%,
Hf: 0.0001 to 0.005% and
Re: 0.0001 to 0.005%.

(3) A method of production of hot coil for line pipe use characterized by heating a steel slab which has a chemical composition which contains, by mass %,
C: 0.03 to 0.10%,
Si: 0.01 to 0.50%,
Mn: 0.5 to 2.5%,
P: 0.001 to 0.03%,
S: 0.0001 to 0.0030%,
Nb: 0.0001 to 0.2%,
Al: 0.0001 to 0.05%,
Ti: 0.0001 to 0.030%, and
B: 0.0001 to 0.0005% and
which has a balance of iron and unavoidable impurities to 1000 to 1250° C., then hot rolling it, during which making a draft ratio in a recrystallization temperature range 1.9 to 4.0 and making the steel plate in the middle of the hot rolling stop at least once between rolling passes in the recrystallization temperature range for 100 to 500 seconds, and cooling the obtained hot rolled steel plate divided between a front stage and a back stage, during which, in the front stage cooling, cooling by a cooling rate of 0.5 to 15° C./sec at a center part of plate thickness of the hot rolled steel plate until a surface temperature of the hot rolled steel plate becomes 600° C. from the cooling start temperature of the front stage, and, in the back stage cooling, cooling by a cooling rate which is faster than the front stage at the center part of plate thickness of the hot rolled steel plate.

(4) The method of production of hot coil for line pipe use as set forth in the above (3) characterized by the steel slab further containing one or more of, by mass %,
Cu: 0.01 to 0.5%,
Ni: 0.01 to 1.0%,
Cr: 0.01 to 1.0%,
Mo: 0.01 to 1.0%,
V: 0.001 to 0.10%,
W: 0.0001 to 0.5%,
Zr: 0.0001 to 0.050%
Ta: 0.0001 to 0.050%
Mg: 0.0001 to 0.010%,
Ca: 0.0001 to 0.005%,
REM: 0.0001 to 0.005%,
Y: 0.0001 to 0.005%,
Hf: 0.0001 to 0.005% and
Re: 0.0001 to 0.005%.

(5) The method of production of hot coil for line pipe use as set forth in the above (3) or (4) characterized by hot rolling by a draft ratio in the non-recrystallization temperature range of 2.5 to 4.0.

(6) The method of production of hot coil for line pipe use as set forth in the above (3) or (4) characterized by starting the front stage cooling from a 800 to 850° C. temperature range and cooling through the 800 to 600° C. temperature range by a cooling rate at the center part of plate thickness of 0.5 to 10° C./sec.

(7) The method of production of hot coil for line pipe use as set forth in the above (5) characterized by starting the front stage cooling from a 800 to 850° C. temperature range and cooling through the 800 to 600° C. temperature range by a cooling rate at the center part of plate thickness of 0.5 to 10° C./sec.

(8) The method of production of hot coil for line pipe use as set forth in the above (3) or (4) characterized by coiling the steel plate, after the back stage cooling, at 450 to 600° C.

(9) The method of production of hot coil for line pipe use as set forth in the above (5) characterized by coiling the steel plate, after the back stage cooling, at 450 to 600° C.

(10) The method of production of hot coil for line pipe use as set forth in the above (6) characterized by coiling the steel plate, after the back stage cooling, at 450 to 600° C.

(11) The method of production of hot coil for line pipe use as set forth in the above (7) characterized by coiling the steel plate, after the back stage cooling, at 450 to 600° C.

Advantageous Effects of Invention

According to the present invention, by making the effective crystal grain size a predetermined value or less and then making the specific matrix structure uniform between the surface and the center of plate thickness, it is possible to provide hot coil for line pipe use which has a small deviation in ordinary temperature strength and which is excellent in low temperature toughness. Further, by making the steel plate in the middle of the hot rolling stop between rolling passes in the recrystallization temperature range and cooling the steel plate after hot rolling in two stages, it is possible to provide a method of production of hot coil for line pipe use which is small deviation in ordinary temperature strength and is excellent in low temperature toughness despite coiling being required in the hot coil.

DESCRIPTION OF EMBODIMENTS

The steel structure, form, and characteristics of the hot coil for line pipe use of the present invention will be explained.

(Steel Structure of Center Part in Plate Thickness: Effective Crystal Grain Size of 2 to 10 μm)

The hot coil for line pipe use of the present invention, to obtain the desired characteristics, first has to have a center part in plate thickness with an effective crystal grain size of the steel structure of 2 to 10 μm in range. If the center part in plate thickness has an effective crystal grain size of the steel structure which exceeds 10 μm, the effect of refinement of the crystal grains cannot be obtained and the desired characteristics cannot be obtained no matter what the matrix structure is made. Preferably, the size is 7 μm or less. On the other hand, even if making the effective crystal grain size of the steel structure at the center part in the plate thickness less than 2 μm, the effect of refinement of the crystal grains becomes saturated. Preferably, the size is made 3 μm or more. Note that, the effective crystal grain size of the steel structure is defined by the circle equivalent diameter of the region surrounded by a boundary which has a crystal orientation difference of 15° or more by using an EBSP (Electron Back Scattering Pattern).

(Steel Structure of Center Part in Plate Thickness: Total of Area Ratios of Bainite and Acicular Ferrite of 60 to 99%)

Figure 1:
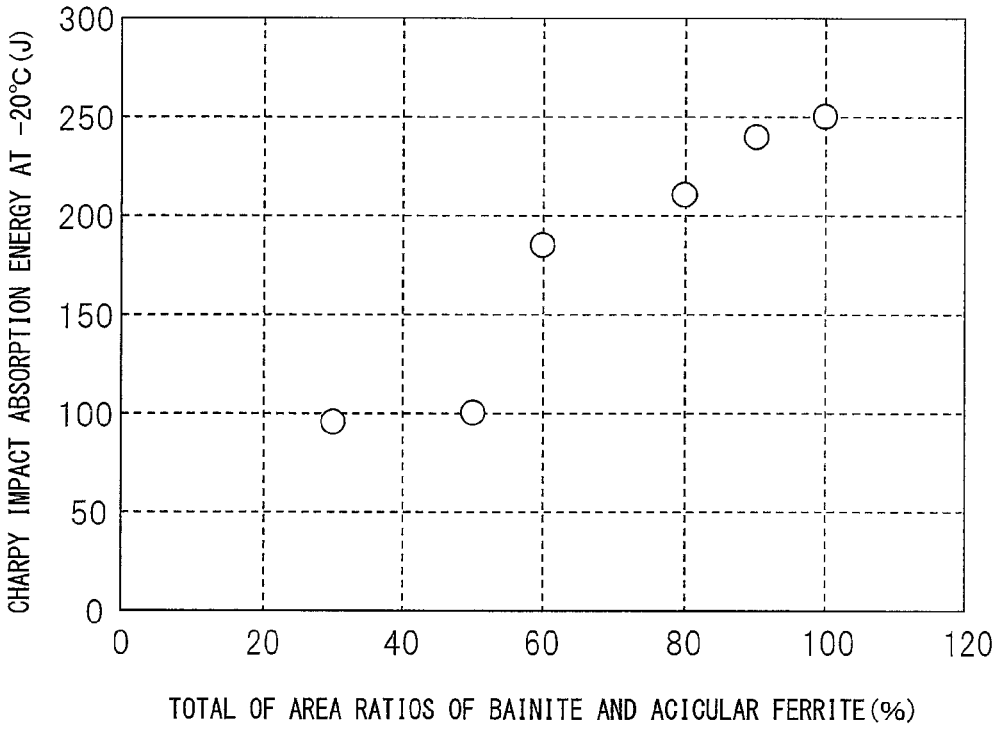
FIG. 1 is a view which shows the relationship between the total of bainite and acicular ferrite and the Charpy impact absorption energy at −20° C. of a hot coil with a plate thickness of 16 mm.

As explained above, in order for a hot coil for line pipe use to obtain the desired characteristics, the effective crystal grain size has to be made 2 to 10 μm, then the total of the area ratios of bainite and acicular ferrite of the matrix structure at the center part in plate thickness has to be made 60 to 99%. If the total of the area ratios of bainite and acicular ferrite is less than 60%, the Charpy absorption energy at −20° C. of the hot coil becomes less than 150J, the DWTT (Drop Weight Tear Test) ductile fracture rate at 0° C. becomes less than 85%, and the low temperature toughness which is required when producing a line pipe cannot be secured. FIG. 1 is a view which shows the relationship between the total of the area ratios of bainite and acicular ferrite and the Charpy impact absorption energy at −20° C. in a hot coil of a plate thickness of 16 mm. As clear from FIG. 1, the Charpy impact absorption energy at −20° C. sharply falls if the total of the area ratios of bainite and acicular ferrite becomes less than 60%.

Further, to make the Charpy impact absorption energy at −40° C. of the hot coil 200J or more and make the DWTT (Drop Weight Tear Test) ductile fracture rate at −20° C. 85% or more, the total of the area ratios of bainite and acicular ferrite is preferably made 80% or more. On the other hand, the higher the total of the area ratios of bainite and acicular ferrite the better, but a hot coil can contain cementite or pearlite or other unavoidable steel structures, so the total of the area ratios of bainite and acicular ferrite is given an upper limit of 99%. Note that, bainite is the structure comprised of carbides precipitating between laths or clump-shaped ferrite or of carbides precipitating in the laths. On the other hand, a structure where carbides do not precipitate between the laths or in the laths is referred to as "martensite" and is differentiated from bainite.

(Absolute Value of A-B of 0 to 30% when Total Of Area Ratios of Bainite and Acicular Ferrite at any Two Portions are Designated as Respectively A and B)

A hot coil for line pipe use generally varies in matrix structure in the thickness direction and the longitudinal direction. To improve the reliability of line pipe, it is necessary to make the matrix structure of the hot coil which is used for production of the line pipe uniform in the thickness direction and longitudinal direction. That is, it is necessary to reduce the difference in matrix structure at any two portions. Here, the absolute value of A-B is defined when designating the totals of the area ratios of bainite and acicular ferrite at any two portions respectively as respectively A and B. If the absolute value of A-B exceeds 30%, this means that the hot coil for line pipe use greatly varies in the matrix structure in the thickness direction and the longitudinal direction. If this deviation is large, the hot coil for line pipe use varies in ordinary temperature strength and, as a result, the plate thickness line pipe falls in reliability. Therefore, the absolute value of A-B is made 30% or less. Preferably, it is made 20% or less. On the other hand, the lower limit of the absolute value of A-B is made 0%. The absolute value of A-B being 0% indicates there is no deviation.

(Plate Thickness: 7 to 25 mm)

If the plate thickness is less than 7 mm, even in the conventional method of production of a hot coil, the absolute value of A-B becomes 0 to 30% in range. However, if the plate thickness is 7 mm or more, if not the later explained method of production of the present invention, the absolute value of A-B cannot be made the above range. In particular, this is remarkable if the plate thickness is 10 mm or more. On the other hand, if the plate thickness is over 25 mm, coiling is not possible. Therefore, the plate thickness of the hot coil of the present invention is made 7 to 25 mm in range. Preferably, it is made 10 to 25 mm in range.

(Tensile Strength TS in Width Direction: 400 to 700 MPa)

The hot coil for line pipe use of the present invention is a material for producing line pipe corresponding to the API standards X60 to X70—the types which are being used the most as trunk line pipes for long distance transport. Therefore, to satisfy the API standards X60 to X70, the tensile strength TS in the width direction has to be made 400 to 700 MPa.

Next, the method of production of a hot coil for line pipe use for obtaining the desired steel structure will be explained.

The hot coil for line pipe use of the present invention is obtained by hot rolling a steel slab which has a predetermined chemical composition. The method of production of the steel slab may be the continuous casting method or the ingot method. Note that, the chemical composition will be explained later.

(Reheating Temperature of Steel Slab: 1000 to 1250° C.)
If the reheating temperature of the steel slab is less than 1000° C., at the time of hot rolling, the time at the recrystallization temperature range becomes short and during the hot rolling the steel plate cannot be made to sufficiently recrystallize. On the other hand, if over 1250° C., the austenite grains coarsen. Therefore, the heating temperature of the steel slab is made 1000 to 1250° C. in range.

(Draft Ratio at Recrystallization Temperature Range: 1.9 to 4.0)
If the draft ratio at the recrystallization temperature range is less than 1.9, no matter how long the steel plate in the middle of hot rolling is made to stop between rolling passes in the recrystallization temperature range, the effective crystal grain size of the steel structure cannot be made 10 μm or less. Preferably, the ratio is 2.5 or more. This is because it is possible to shorten the stopping time of the steel plate in the middle of hot rolling between rolling passes in the recrystallization temperature range. On the other hand, even if exceeding 4.0, the degree of recrystallization after rolling becomes saturated. Preferably the ratio is 3.6 or less. This is because even if the draft ratio is 3.6, recrystallization of an extent substantially free of problems can be obtained.

(Stopping of Steel Plate in Middle of Hot Rolling: 100 to 500 Seconds at Least Once Between Rolling Passes in Recrystallization Temperature Range)
If the plate thickness after the finish rolling, that is, the plate thickness of the hot coil, is less than 7 mm, even if not providing a stopping time in the rough rolling and instead continuously performing the finish rolling, it is possible to promote recrystallization and secure the draft in the non-recrystallization range. As a result, the effective crystal grain size of the steel structure can be made 10 μm or less.

If the steel slab stops between passes of the rough rolling, the productivity falls, so in the past the practice had been to shorten the stopping time between passes as much as possible. However, if, like in the hot coil of the present invention, the plate thickness is 7 mm or more, if not stopping the steel plate in the middle of hot rolling for 100 seconds or more between the rolling passes in the recrystallization temperature range, it is not possible to sufficiently cause the austenite to recrystallize. Further, the draft in the finish rolling cannot be made sufficient either. Therefore, to produce a hot coil of a plate thickness of 7 to 25 mm covered by the present invention, it is necessary to make the steel plate stop for 100 seconds or more at least once between the rolling passes in the middle of the rough rolling of the recrystallization temperature range. Preferably, it is necessary to make it stop for 120 seconds or more. Further, the temperature range for stopping is preferably less than 1000° C. If making the steel plate stop at 1000° C. or more, the grain growth after recrystallization becomes large and the low temperature toughness is made to deteriorate. Further, by performing the remaining passes of the rough rolling after stopping and then performing the finish rolling, the amount of draft in the non-recrystallization range can also be sufficiently secured. As a result, it is possible to make the effective crystal grain size of the steel plate after coiling, that is, the effective crystal grain size of the hot coil for line pipe use, 10 μm or less. On the other hand, even if making the stopping time per stop 500 seconds or more, the temperature of the steel plate in the middle of hot rolling just sharply drops. The extent of recrystallization becomes saturated. Therefore, the stopping time per stop is made 500 seconds or less. Preferably it is 400 seconds or less. Note that, the stopping time in the rolling pass where the steel plate in the middle of hot rolling is not made to stop is 0 second.

Furthermore, in the method of production which is explained next, the total of the area ratios of bainite and acicular ferrite of the matrix structure can be made uniform in the thickness direction and the longitudinal direction. That is, the absolute value of A-B when designating the totals of the area ratios of bainite and acicular ferrite any two portions as respectively A and B can be made 0 to 30% in range.

If cooling the steel plate once after hot rolling and before coiling, the matrix structure varies between the thickness direction and the longitudinal direction. As a result, the hardness of the hot coil obtained by coiling the steel plate varies between the thickness direction and the longitudinal direction. In particular, the deviation in the thickness direction is large. When cooling the steel plate by an aqueous medium, the aqueous media boils. The state of boiling becomes film boiling when the surface temperature of the steel plate is high and becomes nucleate boiling when the surface temperature of the steel plate is low. When the aqueous medium boils by either nucleate boiling or film boiling, the steel plate is stably cooled. Therefore, even if cooling the steel plate once, if instantaneously changing from film boiling to nucleate boiling, the steel plate can be uniformly cooled. However, if once cooling the steel plate, the steel plate is cooled through a temperature range forming transition boiling where both nucleate boiling and film boiling are mixed. If cooling steel plate for a long time in the state of transition boiling, the cooling of the steel plate will not be stable and, as a result, the steel structure will vary in the thickness direction and longitudinal direction of the steel plate. Therefore, the steel plate is made to pass through the temperature range of the transition boiling in a short time so that the steel plate is not cooled for a long time in the state of transition boiling and the cooling of the steel plate after the hot rolling is cooling divided into a front stage and a back stage.

Figure 2:
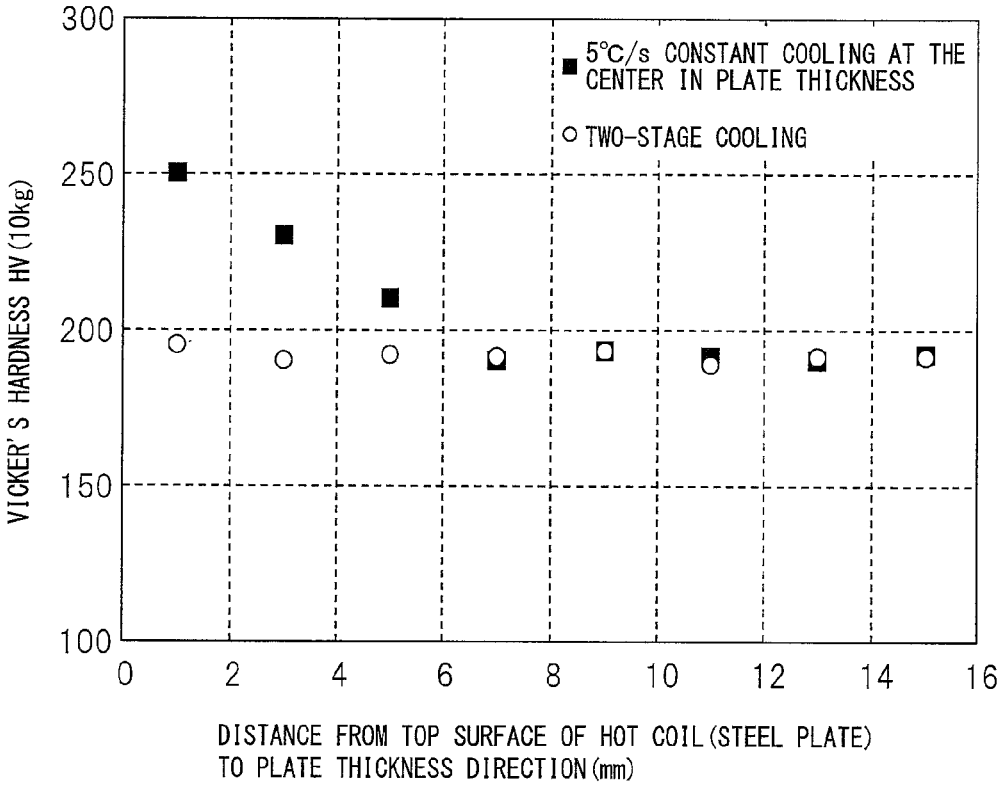
FIG. 2 is a view which shows the effects given by the cooling method on the deviation of steel plate hardness in the thickness direction.

FIG. 2 is a view which shows the effects which the cooling method has on deviation of the steel plate hardness in the thickness direction. As clear from FIG. 2, if cooling the steel plate at one time by a cooling rate at the center in plate thickness of 5° C./sec, the steel plate rises in hardness near the surface layer and does not become constant in hardness in the thickness direction but varies. On the other hand, if performing two-stage cooling, it becomes constant in hardness in the thickness direction and does not vary. The deviation in hardness is due to the deviation in the matrix structure, so it is learned that two-stage cooling is effective for reducing the deviation in the matrix structure in the thickness direction. Note that, such a phenomenon also occurs in the longitudinal direction of the steel plate.

Specifically, by cooling in the following way by a front stage and back stage of two-stage cooling, it is possible to reduce the deviation in the matrix surface structure in the thickness direction and longitudinal direction.

The front stage cooling rate has to be made a cooling rate of 0.5 to 15° C./sec at the center part in plate thickness of the hot rolled steel plate until the surface temperature of the hot rolled steel plate changes from the front stage cooling start temperature to 600° C. In the temperature range where the surface temperature of the hot rolled steel plate changes from the front stage cooling start temperature to 600° C., the aqueous medium will boil by nucleate boiling and transition boiling will not occur. Therefore, the cooling time of the hot rolled steel plate in this temperature range does not particularly have to be shortened, so the cooling rate of the center part in plate thickness does not have to be made over 10° C./sec. Further, if the cooling rate exceeds 15° C./sec, martensite transformation occurs and the formation of bainite is suppressed. From this point as well, making the cooling rate 15° C./sec or less is convenient. Preferably, it is made 8° C./sec or less. On the other hand, if the cooling rate is less than 0.5° C./sec, too much time is taken until the surface temperature of the hot rolled steel plate reaches 600° C. and the productivity is impaired. Therefore, the cooling rate of the center part of plate thickness has to be made 0.5° C./sec or more. Preferably, it is made 3° C./sec or more. Note that, 0.5 to 15° C./sec is the cooling rate of the center part of plate thickness of the hot rolled steel plate, but if converted to the cooling rate of the surface of the hot rolled steel plate, it is 1.0 to 30° C./sec.

The cooling rate of the back stage has to be faster than at the front stage at the center part in plate thickness of the hot rolled steel plate. Due to the front stage cooling, a hot rolled steel plate with a surface temperature of less than 600° C. is supplied for the back stage cooling. If the cooling rate of the back stage is slower than the front stage at the center part in plate thickness of the hot rolled steel plate, when the cooling shifts from the front stage to the back stage, nucleate boiling cannot smoothly shift to film boiling and transition boiling occurs. As a result, the steel plate cannot be uniformly cooled and the matrix structure of the hot rolled steel plate varies in the thickness direction and the longitudinal direction. This is because if the surface of the hot rolled steel plate is 450 to 600° C., transition boiling easily occurs. The preferable cooling rate in the back stage is 40 to 80° C./sec in range at the surface of the steel plate. More preferably it is 50 to 80° C./sec, still more preferably 60 to 80° C./sec in range. If converting these ranges of cooling rates to the cooling rate at the center part of plate thickness, they become 10 to 40° C./sec, 15 to 40° C./sec, and 20 to 40° C./sec in range.

Further, in both the cases of the front stage and back stage, the aqueous medium is supplied to the steel plate surface from both the gravity direction and the counter gravity direction, but the quantities of supply of the aqueous medium in the gravity direction and the counter gravity direction satisfy the following relationship:

$$Qg/Qc = 1 \text{ to } 10$$

where,

Qg: quantity of supply of aqueous medium in gravity direction ($m^3$/sec.)

Qc: quantity of supply of aqueous medium in counter gravity direction ($m^3$/sec.)

To further improve the characteristics of the hot coil for line pipe use of the present invention, it may be produced under the following conditions.

The draft ratio in the non-recrystallization temperature range is preferably made 2.5 to 4.0. This is because if making the draft ratio in the non-recrystallization temperature range 2.5 or more, the effective crystal grain size can be further reduced and made 10 μm or less. On the other hand, even if exceeding 4.0, there is no change in the effective crystal grain size.

The front stage cooling is preferably started at 800 to 850° C. and the cooling rate at the front stage is preferably made 0.5 to 10° C./sec at the center part in plate thickness in the temperature range of the surface temperature of the hot rolled steel plate of 800° C. to 600° C. This is because by making the cooling start temperature of the front stage 800 to 850° C., it is possible to form ferrite and the yield to tensile ratio of the steel plate falls and the deformability is improved.

The coiling temperature after the back stage cooling is preferably made 450 to 600° C. This is because it is possible to further raise the area ratio of the total of bainite and acicular ferrite and possible to further improve the low temperature toughness.

Next, the chemical composition of the hot coil for line pipe use of the present invention will be explained. Note that, in the explanation of the chemical composition, unless indicated in particular otherwise, "%" shall indicate mass %.

(C: 0.03 to 0.10%)

C is an element which is essential as a basic element which improves the strength of the base material in steel. Therefore, addition of 0.03% or more is necessary. On the other hand, excessive addition exceeding 0.10% invites a drop in the weldability and toughness of the steel material, so the upper limit is made 0.10%.

(Si: 0.01 to 0.50%)

Si is an element which is required as a deoxidizing element at the time of steelmaking. 0.01% or more has to be added in the steel. On the other hand, if exceeding 0.50%, when welding the steel plate for producing the line pipe, the HAZ falls in toughness, so the upper limit is made 0.50%.

(Mn: 0.5 to 2.5%)

Mn is an element which is required for securing the strength and toughness of the base material. If Mn exceeds 2.5%, when welding the steel plate for producing the line pipe, the HAZ remarkably falls in toughness. On the other hand, if less than 0.5%, securing the strength of the steel plate becomes difficult. Therefore, Mn is made 0.5 to 2.5% in range.

(P: 0.001 to 0.03%)

P is an element which has an effect on the toughness of steel. If P is over 0.03%, when welding steel plate to form line pipe, not only the base material, but also the HAZ are remarkably lowered in toughness. Therefore, the upper limit is made 0.03%. On the other hand, P is an impurity element, so the content is preferably reduced as much as possible, but due to refining costs, the lower limit is made 0.001%.

(S: 0.0001 to 0.0030%)

S, if excessively added exceeding 0.0030%, becomes a cause of formation of coarse sulfides and causes a reduction in toughness, so the upper limit is made 0.0030%. On the other hand, S is an impurity element, so the content is preferably reduced as much as possible, but due to refining costs, the lower limit is made 0.0001%.

(Nb: 0.0001 to 0.2%)

Nb, by addition in 0.0001% or more, forms carbides and nitrides in the steel and improves the strength. On the other hand, if added exceeding 0.2%, a drop in toughness is invited. Therefore, Nb is made 0.0001 to 0.2% in range.

(Al: 0.0001 to 0.05%)

Al is usually added as a deoxidizing material. However, if added exceeding 0.05%, Ti-based oxides are not formed, so the upper limit is made 0.05%. On the other hand, a certain amount is necessary for reducing the amount of oxygen in the molten steel, so the lower limit is made 0.0001%.

(Ti: 0.0001 to 0.030%)

Ti is added in 0.0001% or more as a deoxidizing material and further as a nitride-forming element so as to refine the crystal grains. However, excessive addition causes a remarkable drop in toughness due to the formation of carbides, so the upper limit is made 0.030%. Therefore, Ti is made 0.0001 to 0.030% in range.

(B: 0.0001 to 0.0005%)

B, if forming a solid solution, causes the hardenability to greatly increase and remarkably suppresses the formation of ferrite. Therefore, the upper limit is made 0.0005%. On the other hand, the lower limit is made 0.0001% from the relationship with the refining costs.

In the present invention, one or more of the following elements may be freely added to further improve the characteristics of the hot coil for line pipe use.

(Cu: 0.01 to 0.5%)

Cu is an element which is effective for raising the strength without causing a drop in the toughness. For raising the strength, addition of 0.01% or more is preferable. On the other hand, if exceeding 0.5%, at the time of heating the steel slab or at the time of welding, cracking easily occurs. Therefore, Cu is preferably 0.01 to 0.5% in range.

(Ni: 0.01 to 1.0%)

Ni is an element effective for improvement of the toughness and strength. To obtain that effect, addition of 0.01% or more is preferable. On the other hand, addition exceeding 1.0% causes the weldability at the time of producing the line pipe to fall, so the upper limit is preferably made 1.0%.

(Cr: 0.01 to 1.0%)

Cr improves the strength of the steel by precipitation strengthening, so addition of 0.01% or more is preferable. On the other hand, if excessively added, the hardenability excessively rises and bainite is excessively formed, so the toughness falls. Therefore, the upper limit is preferably made 1.0%.

(Mo: 0.01 to 1.0%)

Mo improves the hardenability and simultaneously forms carbonitrides and improves the strength. To improve the strength, addition of 0.01% or more is preferable. On the other hand, if exceeding 1.0%, a remarkable drop in toughness is invited, so the upper limit is preferably made 1.0%.

(V: 0.001 to 0.10%)

V forms carbides and nitrides and is effective for improving the strength. To improve the strength, addition of 0.001% or more is preferable. On the other hand, if exceeding 0.10%, a drop in toughness is incurred, so the upper limit is preferably made 1.0%.

(W: 0.0001 to 0.5%)

W has the effect of improving the hardenability and simultaneously forming carbonitrides and improving the strength. To obtain this effect, addition of 0.0001% or more is preferable. On the other hand, excessive addition exceeding 0.5% invites a remarkable drop in toughness, so the upper limit is preferably made 0.5%.

(Zr: 0.0001 to 0.050%)

(Ta: 0.0001 to 0.050%)

Zr and Ta, like Nb, form carbides and nitrides and are effective for improving the strength. For improvement of the strength, Zr and Ta are preferably respectively added in 0.0001% or more. On the other hand, if adding Zr and Ta respectively exceeding 0.050%, a drop in toughness is incurred, so the upper limit is preferably made 0.050% or less.

(Mg: 0.0001 to 0.010%)

Mg is added as a deoxidizing material, but if added exceeding 0.010%, coarse oxides are easily formed and when welding the steel plate for producing the line pipe, the base material and HAZ fall in toughness. On the other hand, if added in less than 0.0001%, in-grain transformation and formation of oxides necessary as pinning grains is made difficult. Therefore, Mg is preferably 0.0001 to 0.010% in range.

(Ca: 0.0001 to 0.005%)

(REM: 0.0001 to 0.005%)

(Y: 0.0001 to 0.005%)

(Hf: 0.0001 to 0.005%)

(Re: 0.0001 to 0.005%)

Ca, REM, Y, Hf, and Re form sulfides and thereby suppress the formation of stretched MnS and improve the characteristics of the steel material in the thickness direction, in particular, lamellar tear resistance. Ca, REM, Y, Hf, and Re do not give this effect of improvement if respectively added in less than 0.0001%. On the other hand, if the amounts added exceed 0.005%, the number of oxides of Ca, REM, Y, Hf, and Re increases and the number of fine oxides which contain Mg decreases. Therefore, these are preferably respectively 0.0001 to 0.005% in range. Note that, the "REM" referred to here is the general term for rare earth elements other than Y, Hf, and Re.

EXAMPLES

Next, the present invention will be further explained by examples, but the conditions of the examples are illustrations of the conditions for confirming the workability and effect of the present invention. The present invention is not limited to these illustrations of conditions. The present invention can employ various conditions so long as not departing from the gist of the present invention and achieving the object of the present invention.

First, steel slabs of thicknesses of 240 mm which have the chemical compositions which are shown in Tables 1 and 2 were heated to 1100 to 1210° C. in range, then rough rolled by hot rolling down to 70 to 100 mm in range in the plate thickness in the 950° C. or more recrystallization temperature range. Next, these were finish rolled by hot rolling down to 3 to 25 mm in range in the plate thickness in the 750 to 880° C. non-recrystallization temperature range. After that, the front stage cooling step was started at surface temperatures of the steel plates of 750 to 850° C. in range, while the back stage cooling step was started at surface temperatures of the steel plates of 550 to 700° C. in range. After that, the steel plates were coiled at 420 to 630° C. in range to obtain the hot coils for line pipe use. Tables 3 to 4 show the detailed production conditions. Note that, the "transport thickness" in Tables 3 to 4 are the plate thicknesses of the steel plates when the rough rolling ends and finish rolling is shifted to.

TABLE 1

| | Chemical Composition (mass %) | | | | | | | | | | | | | |
|---|---|---|---|---|---|---|---|---|---|---|---|---|---|---|
| Steel No. | C | Si | Mn | P | S | Nb | Al | Ti | B | Cu | Ni | Cr | Mo | Remarks |
| 1 | 0.055 | 0.25 | 1.85 | 0.005 | 0.0005 | 0.02 | 0.004 | 0.012 | 0.0003 | 0.15 | 0.15 | — | — | Inv. steel |
| 2 | 0.055 | 0.13 | 1.81 | 0.008 | 0.0006 | 0.04 | 0.013 | 0.003 | 0.0003 | 0.10 | 0.15 | — | 0.10 | Inv. steel |
| 3 | 0.060 | 0.08 | 1.70 | 0.003 | 0.0008 | 0.03 | 0.008 | 0.012 | 0.0003 | — | 0.20 | — | 0.10 | Inv. steel |
| 4 | 0.056 | 0.07 | 1.60 | 0.004 | 0.0003 | 0.01 | 0.010 | 0.016 | 0.0003 | — | — | — | 0.20 | Inv. steel |
| 5 | 0.060 | 0.25 | 1.85 | 0.009 | 0.0006 | 0.01 | 0.007 | 0.012 | 0.0003 | 0.20 | 0.30 | — | — | Inv. steel |
| 6 | 0.045 | 0.10 | 1.85 | 0.026 | 0.0004 | 0.03 | 0.016 | 0.012 | 0.0003 | — | 0.15 | — | — | Inv. steel |
| 7 | 0.036 | 0.02 | 1.80 | 0.003 | 0.0006 | 0.03 | 0.005 | 0.013 | 0.0003 | 0.20 | 0.10 | — | — | Inv. steel |
| 8 | 0.035 | 0.15 | 1.90 | 0.007 | 0.0005 | 0.05 | 0.013 | 0.008 | 0.0003 | — | — | 0.30 | — | Inv. steel |
| 9 | 0.035 | 0.17 | 1.90 | 0.005 | 0.0002 | 0.03 | 0.013 | 0.010 | 0.0003 | — | — | 0.30 | — | Inv. steel |
| 10 | 0.050 | 0.20 | 2.20 | 0.008 | 0.0004 | 0.05 | 0.004 | 0.030 | 0.0003 | — | — | — | — | Inv. steel |

TABLE 1-continued

| Steel No. | Chemical Composition (mass %) | | | | | | | | | | | | | Remarks |
|---|---|---|---|---|---|---|---|---|---|---|---|---|---|---|
| | C | Si | Mn | P | S | Nb | Al | Ti | B | Cu | Ni | Cr | Mo | |
| 11 | 0.056 | 0.22 | 1.65 | 0.002 | 0.0003 | 0.11 | 0.004 | 0.024 | 0.0003 | — | 0.30 | — | 0.20 | Inv. steel |
| 12 | 0.048 | 0.25 | 1.65 | 0.004 | 0.0006 | 0.03 | 0.010 | 0.012 | 0.0003 | — | 0.40 | 0.50 | — | Inv. steel |
| 13 | 0.035 | 0.31 | 1.85 | 0.006 | 0.0008 | 0.01 | 0.015 | 0.024 | 0.0003 | — | 0.20 | 0.40 | — | Inv. steel |
| 14 | 0.046 | 0.09 | 2.12 | 0.006 | 0.0006 | 0.04 | 0.001 | 0.013 | 0.0003 | — | 0.35 | 0.30 | — | Inv. steel |
| 15 | 0.040 | 0.28 | 1.80 | 0.004 | 0.0004 | 0.01 | 0.006 | 0.012 | 0.0003 | — | 0.50 | — | 0.30 | Inv. steel |
| 16 | 0.050 | 0.32 | 2.00 | 0.003 | 0.0006 | 0.01 | 0.006 | 0.008 | 0.0003 | — | 0.20 | — | — | Inv. steel |
| 17 | 0.060 | 0.48 | 1.85 | 0.002 | 0.0006 | 0.02 | 0.003 | 0.010 | 0.0003 | — | — | 0.10 | 0.10 | Inv. steel |
| 18 | 0.035 | 0.24 | 2.00 | 0.004 | 0.0006 | 0.07 | 0.003 | 0.005 | 0.0003 | — | 0.30 | — | 0.10 | Inv. steel |
| 19 | 0.035 | 0.28 | 1.75 | 0.017 | 0.0003 | 0.01 | 0.016 | 0.026 | 0.0003 | — | 0.40 | 0.30 | — | Inv. steel |
| 20 | 0.030 | 0.12 | 1.70 | 0.003 | 0.0005 | 0.02 | 0.022 | 0.012 | 0.0003 | 0.50 | 0.20 | — | 0.20 | Inv. steel |
| 21 | 0.036 | 0.31 | 1.60 | 0.002 | 0.0008 | 0.06 | 0.003 | 0.017 | 0.0003 | — | — | — | — | Inv. steel |
| 22 | 0.034 | 0.31 | 1.55 | 0.004 | 0.0025 | 0.05 | 0.025 | 0.018 | 0.0003 | — | 0.40 | 0.30 | 0.10 | Inv. steel |
| 23 | 0.001 | 0.18 | 2.00 | 0.005 | 0.0026 | 0.05 | 0.005 | 0.012 | 0.0003 | — | — | 0.30 | — | Comp. steel |
| 24 | 0.150 | 0.45 | 1.75 | 0.007 | 0.0015 | 0.03 | 0.016 | 0.013 | 0.0003 | 0.20 | 0.20 | — | 0.10 | Comp. steel |
| 25 | 0.030 | 0.01 | 3.50 | 0.015 | 0.0021 | 0.01 | 0.017 | 0.008 | 0.0003 | — | — | — | — | Comp. steel |
| 26 | 0.060 | 0.25 | 1.93 | 0.040 | 0.0026 | 0.04 | 0.009 | 0.019 | 0.0003 | — | — | — | — | Comp. steel |
| 27 | 0.045 | 0.17 | 1.86 | 0.003 | 0.0351 | 0.02 | 0.005 | 0.017 | 0.0003 | — | — | — | 0.30 | Comp. steel |
| 28 | 0.060 | 0.05 | 1.70 | 0.005 | 0.0030 | 0.03 | 0.100 | 0.023 | 0.0003 | — | — | 0.30 | — | Comp. steel |
| 29 | 0.059 | 0.09 | 1.60 | 0.003 | 0.0009 | 0.03 | 0.003 | 0.064 | 0.0003 | — | — | — | 0.30 | Comp. steel |
| 30 | 0.046 | 0.12 | 1.85 | 0.024 | 0.0008 | 0.01 | 0.014 | 0.015 | 0.0003 | — | 0.13 | — | — | Inv. steel |
| 31 | 0.060 | 0.05 | 1.96 | 0.002 | 0.0015 | 0.03 | 0.160 | 0.010 | 0.0003 | — | — | — | 0.30 | Comp. steel |
| 32 | 0.055 | 0.12 | 1.70 | 0.007 | 0.0021 | 0.02 | 0.020 | 0.015 | 0.0003 | — | 0.50 | 0.50 | 0.10 | Inv. steel |
| 33 | 0.045 | 0.15 | 1.65 | 0.009 | 0.0015 | 0.03 | 0.015 | 0.012 | 0.0003 | 0.20 | 0.10 | — | 0.10 | Inv. steel |
| 34 | 0.052 | 0.20 | 1.60 | 0.010 | 0.0013 | 0.04 | 0.013 | 0.010 | 0.0003 | 0.40 | 0.20 | — | 0.15 | Inv. steel |
| 35 | 0.036 | 0.15 | 1.55 | 0.006 | 0.0009 | 0.03 | 0.025 | 0.009 | 0.0003 | — | 0.50 | 0.40 | — | Inv. steel |
| 36 | 0.050 | 1.50 | 1.50 | 0.010 | 0.0020 | 0.03 | 0.020 | 0.012 | 0.0003 | — | 0.20 | — | — | Comp. steel |
| 37 | 0.055 | 0.20 | 0.10 | 0.012 | 0.0015 | 0.03 | 0.015 | 0.010 | 0.0003 | — | — | 0.20 | — | Comp. steel |
| 38 | 0.045 | 0.15 | 1.50 | 0.008 | 0.0026 | 0.50 | 0.030 | 0.008 | 0.0003 | — | — | — | — | Comp. steel |
| 39 | 0.060 | 0.12 | 1.60 | 0.015 | 0.0024 | 0.03 | 0.100 | 0.009 | 0.0003 | — | — | — | 0.10 | Comp. steel |
| 40 | 0.080 | 0.10 | 1.70 | 0.020 | 0.0016 | 0.03 | 0.040 | 0.050 | 0.0003 | — | — | — | — | Comp. steel |
| 41 | 0.045 | 0.10 | 1.85 | 0.026 | 0.0004 | 0.03 | 0.016 | 0.012 | 0.0003 | 0.15 | 0.15 | — | — | Inv. steel |
| 42 | 0.055 | 0.25 | 1.85 | 0.005 | 0.0005 | 0.02 | 0.004 | 0.012 | 0.0003 | — | — | — | — | Inv. steel |

Note 1)
"—" indicates not added.
Note 2)
Underlines indicate outside scope of present invention.

TABLE 2

(Continuation of Table 1)

| Steel no. | Chemical Composition (mass %) | | | | | | | | | | Remarks |
|---|---|---|---|---|---|---|---|---|---|---|---|
| | V | W | Zr | Ta | Mg | Ca | REM | Y | Hf | Re | |
| 1 | — | — | — | — | — | — | — | — | — | — | Inv. steel |
| 2 | 0.06 | — | — | — | — | 0.0012 | — | — | — | — | Inv. steel |
| 3 | 0.04 | — | — | — | — | — | 0.0008 | — | — | — | Inv. steel |
| 4 | — | — | 0.0051 | — | — | — | — | — | — | — | Inv. steel |
| 5 | — | 0.050 | — | 0.0032 | — | — | — | — | — | — | Inv. steel |
| 6 | — | — | 0.0012 | — | — | 0.0021 | — | — | — | — | Inv. steel |
| 7 | 0.02 | — | — | — | 0.0038 | — | — | — | — | — | Inv. steel |
| 8 | — | — | — | — | — | 0.0022 | — | — | — | — | Inv. steel |
| 9 | — | — | — | — | — | — | — | — | — | — | Inv. steel |
| 10 | — | — | — | — | 0.0018 | 0.0024 | — | — | — | — | Inv. steel |
| 11 | 0.06 | — | — | — | — | — | 0.0042 | — | — | — | Inv. steel |
| 12 | — | — | 0.0137 | — | — | — | — | — | — | — | Inv. steel |
| 13 | 0.02 | — | — | — | — | — | — | 0.001 | — | — | Inv. steel |
| 14 | — | — | — | — | 0.0033 | 0.0035 | — | — | — | — | Inv. steel |
| 15 | — | — | — | — | — | — | — | — | — | — | Inv. steel |
| 16 | — | — | — | — | — | — | 0.0007 | — | — | — | Inv. steel |
| 17 | — | — | 0.0008 | — | — | — | — | — | — | — | Inv. steel |
| 18 | — | — | — | 0.0229 | — | — | — | — | — | 0.001 | Inv. steel |
| 19 | — | — | — | — | — | — | 0.0006 | — | — | — | Inv. steel |
| 20 | — | — | — | — | 0.0025 | 0.0017 | — | — | — | — | Inv. steel |
| 21 | — | — | — | — | — | — | — | — | 0.001 | — | Inv. steel |
| 22 | — | — | — | — | — | 0.0021 | | — | — | — | Inv. steel |
| 23 | 0.05 | — | — | — | — | — | — | — | — | — | Comp. steel |
| 24 | 0.20 | — | — | — | — | 0.0013 | — | — | — | — | Comp. steel |
| 25 | — | — | — | — | — | — | 0.0012 | — | — | — | Comp. steel |
| 26 | | — | — | — | — | — | — | — | — | — | Comp. steel |
| 27 | — | — | — | — | 0.0005 | — | — | — | — | — | Comp. steel |

TABLE 2-continued (Continuation of Table 1)

| Steel no. | Chemical Composition (mass %) V | W | Zr | Ta | Mg | Ca | REM | Y | Hf | Re | Remarks |
|---|---|---|---|---|---|---|---|---|---|---|---|
| 28 | 0.08 | — | — | — | — | — | — | — | — | — | Comp. steel |
| 29 | | — | — | — | — | 0.0017 | — | — | — | — | Comp. steel |
| 30 | — | — | — | — | — | — | — | — | — | — | Inv. steel |
| 31 | — | | — | | — | — | 0.0007 | — | — | — | Comp. steel |
| 32 | — | — | — | — | — | — | — | — | — | — | Inv. steel |
| 33 | 0.03 | — | — | — | — | 0.0015 | — | — | — | — | Inv. steel |
| 34 | — | — | — | — | — | — | — | — | — | — | Inv. steel |
| 35 | 0.04 | — | — | — | — | — | — | — | — | — | Inv. steel |
| 36 | — | — | — | — | | — | — | — | — | — | Comp. steel |
| 37 | — | — | — | — | — | — | — | — | — | — | Comp. steel |
| 38 | — | — | — | — | — | — | — | — | — | — | Comp. steel |
| 39 | — | — | — | — | — | — | — | — | — | — | Comp. steel |
| 40 | 0.06 | — | — | — | — | — | — | — | — | — | Comp. steel |
| 41 | — | — | — | — | — | — | — | — | — | — | Inv. steel |
| 42 | — | — | — | — | — | — | — | — | — | — | Inv. steel |

TABLE 3

| Hot coil no. | Steel no. | Steel slab thickness (mm) | Transport thickness (mm) | Hot coil plate thickness (mm) | Heating temp. (° C.) | Rough rolling: Recrystallization temperature range draft ratio | No. of passes (stages) | Stopping pass (stage no.) | | | Stopping temp. (° C.) | Stopping time (s) | | | Finish rolling Recrystallization temp. range draft ratio |
|---|---|---|---|---|---|---|---|---|---|---|---|---|---|---|---|
| 1 | 1 | 240 | 70 | 14 | 1100 | 3.4 | 12 | 12 | — | — | 940 | 200 | — | — | 3.0 |
| 2 | 2 | 240 | 100 | 20 | 1150 | 2.4 | 9 | 9 | — | — | 950 | 300 | — | — | 3.5 |
| 3 | 3 | 300 | 125 | 25 | 1150 | 1.9 | 9 | 9 | — | — | 940 | 350 | — | — | 4.0 |
| 4 | 4 | 240 | 75 | 15 | 1200 | 3.2 | 10 | 10 | — | — | 930 | 250 | — | — | 3.5 |
| 5 | 5 | 240 | 95 | 19 | 1100 | 2.5 | 10 | 10 | — | — | 920 | 300 | — | — | 2.8 |
| 6 | 6 | 240 | 100 | 20 | 1150 | 2.4 | 9 | 9 | — | — | 930 | 350 | — | — | 3.2 |
| 7 | 7 | 240 | 75 | 15 | 1200 | 3.2 | 10 | 10 | — | — | 940 | 250 | — | — | 3.0 |
| 8 | 8 | 240 | 80 | 16 | 1150 | 3.0 | 10 | 10 | — | — | 920 | 250 | — | — | 2.8 |
| 9 | 9 | 240 | 100 | 18 | 1200 | 2.4 | 9 | 9 | — | — | 930 | 400 | — | — | 3.6 |
| 10 | 10 | 240 | 100 | 18 | 1100 | 2.4 | 9 | 9 | — | — | 940 | 350 | — | — | 4.0 |
| 11 | 11 | 240 | 75 | 15 | 1150 | 3.2 | 10 | 10 | — | — | 950 | 250 | — | — | 3.4 |
| 12 | 12 | 240 | 60 | 12 | 1200 | 4.0 | 14 | 14 | — | — | 940 | 200 | — | — | 2.7 |
| 13 | 13 | 240 | 85 | 17 | 1100 | 2.8 | 11 | 11 | — | — | 930 | 250 | — | — | 3.3 |
| 14 | 14 | 240 | 60 | 12 | 1150 | 4.0 | 13 | 13 | — | — | 940 | 200 | — | — | 3.7 |
| 15 | 15 | 240 | 100 | 20 | 1200 | 2.4 | 9 | 8 | 9 | — | 950 | 150 | 200 | — | 2.9 |
| 16 | 16 | 240 | 80 | 16 | 1100 | 3.0 | 12 | 11 | 12 | — | 930 | 150 | 100 | — | 3.2 |
| 17 | 17 | 240 | 95 | 19 | 1150 | 2.5 | 11 | 10 | 11 | — | 940 | 100 | 200 | — | 3.5 |
| 18 | 18 | 240 | 95 | 19 | 1100 | 2.5 | 10 | 9 | 10 | — | 930 | 100 | 250 | — | 3.6 |
| 19 | 19 | 240 | 80 | 16 | 1200 | 3.0 | 12 | 10 | 11 | 12 | 940 | 100 | 100 | 100 | 2.9 |
| 20 | 20 | 240 | 100 | 20 | 1150 | 2.4 | 10 | 8 | 9 | 10 | 920 | 100 | 100 | 100 | 3.0 |
| 21 | 21 | 240 | 65 | 13 | 1100 | 3.7 | 14 | 12 | 13 | 14 | 950 | 100 | 100 | 100 | 3.0 |
| 22 | 22 | 240 | 85 | 17 | 1150 | 2.8 | 11 | 10 | 11 | — | 940 | 100 | 200 | — | 3.2 |
| 23 | 23 | 240 | 75 | 15 | 1100 | 3.2 | 10 | 10 | — | — | 930 | 250 | — | — | 3.7 |
| 24 | 24 | 240 | 75 | 15 | 1200 | 3.2 | 10 | 10 | — | — | 940 | 300 | — | — | 4.0 |
| 25 | 25 | 240 | 100 | 19 | 1100 | 2.4 | 9 | 9 | — | — | 950 | 300 | — | — | 4.3 |

| Hot coil no. | Front stage cooling: Water cooling start steel plate surface temp. (° C.) | Plate thickness center cooling rate (° C./s) | Steel plate surface cooling rate (° C./s) | Back stage cooling: Water cooling start steel plate surface temp. (° C.) | Plate thickness center cooling rate (° C./s) | Steel plate surface cooling rate (° C./s) | Coiling temp. (° C.) | Remarks |
|---|---|---|---|---|---|---|---|---|
| 1 | 800 | 10 | 20 | 599 | 20 | 60 | 500 | Inv. ex. |
| 2 | 770 | 10 | 20 | 599 | 20 | 60 | 480 | Inv. ex. |
| 3 | 830 | 10 | 20 | 599 | 20 | 60 | 550 | Inv. ex. |
| 4 | 830 | 5 | 10 | 599 | 10 | 30 | 580 | Inv. ex. |
| 5 | 770 | 8 | 16 | 599 | 15 | 45 | 575 | Inv. ex. |
| 6 | 750 | 9 | 18 | 599 | 20 | 60 | 525 | Inv. ex. |
| 7 | 790 | 10 | 20 | 599 | 20 | 60 | 540 | Inv. ex. |
| 8 | 750 | 12 | 24 | 599 | 20 | 60 | 580 | Inv. ex. |
| 9 | 770 | 10 | 20 | 599 | 20 | 60 | 600 | Inv. ex. |
| 10 | 760 | 10 | 20 | 599 | 20 | 60 | 470 | Inv. ex. |
| 11 | 790 | 9 | 18 | 599 | 15 | 45 | 520 | Inv. ex. |

TABLE 3-continued

| | | | | | | | | |
|---|---|---|---|---|---|---|---|---|
| 12 | 780 | 12 | 24 | 599 | 25 | 75 | 530 | Inv. ex. |
| 13 | 795 | 10 | 20 | 599 | 20 | 60 | 570 | Inv. ex. |
| 14 | 780 | 9 | 18 | 599 | 20 | 60 | 520 | Inv. ex. |
| 15 | 815 | 13 | 26 | 599 | 25 | 75 | 500 | Inv. ex. |
| 16 | 830 | 14 | 28 | 599 | 25 | 75 | 525 | Inv. ex. |
| 17 | 820 | 15 | 30 | 599 | 30 | 90 | 450 | Inv. ex. |
| 18 | 795 | 10 | 20 | 599 | 20 | 60 | 5D0 | Comp. ex. |
| 19 | 790 | 10 | 20 | 599 | 20 | 60 | 520 | Comp. ex. |
| 20 | 850 | 9 | 18 | 599 | 20 | 60 | 580 | Comp. ex. |
| 21 | 830 | 12 | 24 | 599 | 25 | 75 | 520 | Comp. ex. |
| 22 | 800 | 11 | 22 | 599 | 24 | 72 | 470 | Comp. ex. |
| 23 | 790 | 10 | 20 | 599 | 20 | 60 | 580 | Comp. ex. |
| 24 | 800 | 10 | 20 | 599 | 20 | 60 | 470 | Comp. ex. |
| 25 | 820 | 5 | 10 | 599 | 15 | 45 | 420 | Comp. ex. |

TABLE 4

| | | | | | | Rough rolling | | | | | | | | | |
|---|---|---|---|---|---|---|---|---|---|---|---|---|---|---|---|
| Hot coil no. | Steel no. | Steel slab thick-ness (iron) | Trans-port thick-ness (mm) | Hot coil plate thick-ness (mm) | Heating temp. (° C.) | Recrystalli-zation temperature range draft ratio | No. of passes (stages) | Stopping pass (stage no.) | | | Stopping temp. (° C.) | Stopping time (s) | | | Finish rolling Recrystalli-zation temp. range draft ratio |
| 26 | 26 | 240 | 100 | 18 | 1200 | 2.4 | 9 | 9 | — | — | 950 | 300 | — | — | 2.6 |
| 27 | 27 | 240 | 75 | 15 | 1100 | 3.2 | 10 | 10 | — | — | 940 | 200 | — | — | 3.7 |
| 28 | 28 | 240 | 85 | 17 | 1150 | 2.8 | 10 | 10 | — | — | 955 | 300 | — | — | 3.4 |
| 29 | 29 | 240 | 95 | 19 | 1150 | 2.5 | 10 | 10 | — | — | 940 | 300 | — | — | 3.0 |
| 30 | 30 | 240 | 100 | 18 | 1100 | 2.4 | 8 | 8 | — | — | 930 | 350 | — | — | 3.4 |
| 31 | 31 | 240 | 95 | 19 | 1150 | 2.5 | 10 | 9 | 10 | — | 940 | 150 | 150 | — | 3.0 |
| 32 | 32 | 240 | 80 | 16 | 1150 | 3.0 | 9 | 9 | — | — | 93D | 250 | — | — | 3.4 |
| 33 | 33 | 240 | 60 | 14 | 1150 | 4.0 | 11 | 11 | — | — | 940 | 200 | — | — | 4.3 |
| 34 | 34 | 240 | 85 | 17 | 1150 | 2.8 | 10 | 10 | — | — | 950 | 300 | — | — | 3.5 |
| 35 | 35 | 240 | 80 | 16 | 1100 | 3.0 | 9 | 9 | — | — | 950 | 350 | — | — | 1.1 |
| 36 | 36 | 240 | 70 | 14 | 1100 | 3.4 | 10 | 9 | 10 | — | 940 | 150 | 100 | — | 3.0 |
| 37 | 37 | 240 | 100 | 20 | 1150 | 2.4 | 9 | 8 | 9 | — | 930 | 200 | 150 | — | 3.5 |
| 38 | 38 | 300 | 125 | 25 | 1150 | 1.9 | 6 | 5 | 6 | — | 920 | 100 | 200 | — | 4.0 |
| 39 | 39 | 240 | 75 | 15 | 1200 | 3.2 | 9 | 7 | 8 | 9 | 930 | 100 | 100 | 100 | 3.5 |
| 40 | 40 | 240 | 95 | 19 | 1100 | 2.5 | 10 | 8 | 9 | 10 | 920 | 100 | 100 | 150 | 2.8 |
| 41 | 41 | 240 | 100 | 20 | 1150 | 2.4 | 8 | 7 | 8 | — | 940 | 100 | 200 | — | 3.2 |
| 42 | 42 | 240 | 75 | 15 | 1150 | 3.2 | 8 | 8 | — | — | 950 | 250 | — | — | 3.5 |
| 43 | 1 | 240 | 160 | 25 | 1150 | 1.5 | 5 | 5 | — | — | 940 | 400 | — | — | 3.0 |
| 44 | 1 | 240 | 57 | 11 | 1150 | 4.2 | 14 | 14 | — | — | 930 | 150 | — | — | 3.5 |
| 45 | 1 | 240 | 75 | 15 | 1150 | 3.2 | 9 | 9 | — | — | 930 | 300 | — | — | 3.5 |
| 46 | 1 | 240 | 75 | 15 | 1280 | 3.2 | 9 | 9 | — | — | 920 | 300 | — | — | 3.5 |
| 47 | 1 | 240 | 75 | 15 | 1150 | 3.2 | 10 | 10 | — | — | 940 | 20 | — | — | 3.5 |
| 48 | 1 | 240 | 75 | 15 | 1150 | 3.2 | 9 | 9 | — | — | 950 | 300 | — | — | 3.2 |
| 49 | 1 | 240 | 75 | 6 | 1150 | 3.2 | 10 | 10 | — | — | 940 | 350 | — | — | 3.0 |
| 50 | 1 | 240 | 75 | 15 | 1150 | 3.2 | — | — | — | — | 950 | — | — | — | 3.0 |
| 51 | 1 | 240 | 75 | 15 | 1200 | 3.2 | 9 | 9 | — | — | 1100 | 3D0 | — | — | 3.0 |

| | Front stage cooling | | | Back stage cooling | | | | |
|---|---|---|---|---|---|---|---|---|
| Hot coil no. | Water cooling start steel plate surface temp. (° C.) | Plate thickness center cooling rate (° C./s) | Steel plate surface cooling rate (° C./s) | Water cooling start steel plate surface temp. (° C.) | Plate thickness center cooling rate (° C./s) | Steel plate surface cooling rate (° C./s) | Coiling temp. (° C.) | Remarks |
| 26 | 840 | 10 | 20 | 599 | 20 | 40 | 500 | Comp. ex. |
| 27 | 760 | 9 | 18 | 599 | 20 | 40 | 450 | Comp. ex. |
| 28 | 770 | 12 | 24 | 599 | 25 | 50 | 600 | Comp. ex. |
| 29 | 790 | 13 | 26 | 599 | 25 | 50 | 550 | Comp. ex. |
| 30 | 780 | 80 | 160 | 599 | 85 | 170 | 470 | Comp. ex. |
| 31 | 760 | 13 | 26 | 599 | 25 | 50 | 550 | Comp. ex. |
| 32 | 780 | 12 | 24 | 599 | 25 | 50 | 500 | Comp. ex. |
| 33 | 770 | 80 | 160 | 599 | 10 | 20 | 520 | Comp. ex. |
| 34 | 600 | 10 | 20 | 599 | 20 | 40 | 580 | Comp. ex. |
| 35 | 760 | 9 | 18 | 599 | 20 | 40 | 600 | Comp. ex. |
| 36 | 800 | 10 | 20 | 599 | 20 | 40 | 500 | Comp. ex. |
| 37 | 770 | 10 | 20 | 599 | 20 | 40 | 480 | Comp. ex. |
| 38 | 830 | 10 | 20 | 599 | 20 | 40 | 550 | Comp. ex. |
| 39 | 830 | 5 | 10 | 599 | 20 | 40 | 580 | Comp. ex. |
| 40 | 770 | 8 | 16 | 599 | 20 | 40 | 575 | Comp. ex. |
| 41 | 750 | 9 | 18 | 599 | 20 | 40 | 525 | Comp. ex. |
| 42 | 810 | 8 | 16 | 599 | 20 | 40 | 500 | Inv. ex. |

TABLE 4-continued

| | | | | | | | | |
|---|---|---|---|---|---|---|---|---|
| 43 | 810 | 8 | 16 | 599 | 20 | 40 | 500 | Comp. ex. |
| 44 | 810 | 8 | 16 | 599 | 20 | 40 | 500 | Comp. ex. |
| 45 | 810 | 20 | 40 | 599 | 30 | 60 | 500 | Comp. ex. |
| 46 | 810 | 8 | 16 | 599 | 20 | 40 | 500 | Comp. ex. |
| 47 | 810 | 8 | 15 | 599 | 20 | 40 | 500 | Comp. ex. |
| 48 | 810 | 10 | 20 | 599 | 2 | 4 | 500 | Comp. ex. |
| 49 | 810 | 30 | 60 | 599 | 40 | 80 | 500 | Comp. ex. |
| 50 | 800 | 10 | 20 | 599 | 20 | 40 | 500 | Comp. ex. |
| 51 | 830 | 10 | 20 | 599 | 20 | 40 | 500 | Inv. ex. |

The inventors investigated the steel structure and mechanical properties of the hot coils obtained in this way. The matrix structure was measured for the total of the area ratios of bainite and acicular ferrite at the center part in plate thickness and also in the thickness direction at every 2 mm and in the longitudinal direction at every 5000 mm. Further, 10 sets of any two of the measurement portions were selected, the absolute values of A-B were calculated for the sets, and the minimum value and maximum value of the absolute values at the calculated 10 sets were found. The effective crystal grain size was measured at the center part in plate thickness of the hot coil by the method using the above-mentioned EBSP. Further, at the measurement positions of the matrix structure, the Vicker's hardnesses Hv were also measured, the maximum value and minimum value were found in the same way as the matrix structure, and the difference was made the deviation.

At the center part in plate thickness of the hot coil in the longitudinal direction at every 1 mm, two each full thickness test pieces based on the API 5L standard were taken in the width direction of the hot coil. Tensile tests were run to find the tensile strengths (TS), yield strengths, and yield to tensile ratios. The tensile tests were run based on the API standard 2000. Further, the average values of the test results of the test pieces were found and the differences between the maximum values and minimum values were found and defined as the deviation.

Further, three each Charpy impact test pieces and DWT test pieces were taken from the center part of plate thickness of the hot coil and were subjected to Charpy impact tests and DWT tests based on the API standard 2000.

The results of the investigation are shown in Tables 5 to 6.

TABLE 5

| Hot coil no. | Steel no. | Plate thickness center: Total of area ratios of bainite and acicular ferrite (%) | Plate thickness center: Effective crystal grain size (μm) | Any two portions Absolute value of A-B (%): Min. | Any two portions Absolute value of A-B (%): Max. | Tensile strength (TS) (MPa): Average | Tensile strength (TS) (MPa): Deviation | Yield strength (MPa): Average | Yield strength (MPa): Deviation | Yield to tensile ratio: Average | Yield to tensile ratio: Deviation |
|---|---|---|---|---|---|---|---|---|---|---|---|
| 1 | 1 | 85 | 5 | 10 | 25 | 630 | 50 | 492 | 55 | 78 | 4 |
| 2 | 2 | 88 | 4 | 6 | 31 | 646 | 45 | 517 | 50 | 80 | 3 |
| 3 | 3 | 80 | 3 | 4 | 19 | 614 | 40 | 522 | 45 | 85 | 3 |
| 4 | 4 | 82 | 4 | 6 | 21 | 576 | 46 | 432 | 51 | 75 | 3 |
| 5 | 5 | 86 | 6 | 0 | 15 | 668 | 35 | 514 | 40 | 77 | 3 |
| 6 | 6 | 87 | 5 | 10 | 25 | 545 | 50 | 447 | 55 | 82 | 4 |
| 7 | 7 | 95 | 4 | 6 | 21 | 533 | 46 | 416 | 51 | 78 | 3 |
| 8 | 8 | 90 | 3 | 10 | 25 | 570 | 52 | 467 | 57 | 82 | 4 |
| 9 | 9 | 99 | 4 | 13 | 28 | 576 | 55 | 478 | 60 | 83 | 4 |
| 10 | 10 | 80 | 6 | 6 | 21 | 633 | 45 | 507 | 50 | 80 | 3 |
| 11 | 11 | 86 | 6 | 4 | 19 | 647 | 40 | 511 | 45 | 79 | 3 |
| 12 | 12 | 91 | 5 | 0 | 15 | 648 | 35 | 499 | 40 | 77 | 3 |
| 13 | 13 | 94 | 4 | 10 | 25 | 622 | 50 | 466 | 55 | 75 | 4 |
| 14 | 14 | 97 | 3 | 6 | 21 | 668 | 45 | 541 | 50 | 81 | 3 |
| 15 | 15 | 84 | 4 | 15 | 30 | 637 | 60 | 529 | 65 | 83 | 4 |
| 16 | 16 | 86 | 6 | 6 | 21 | 623 | 45 | 523 | 50 | 84 | 3 |
| 17 | 17 | 88 | 4 | 10 | 25 | 685 | 50 | 548 | 55 | 80 | 4 |
| 18 | 18 | 91 | 3 | 6 | 21 | 588 | 45 | 453 | 50 | 77 | 3 |
| 19 | 19 | 90 | 5 | 8 | 23 | 583 | 48 | 420 | 53 | 72 | 3 |
| 20 | 20 | 89 | 3 | 2 | 17 | 611 | 38 | 458 | 43 | 75 | 3 |
| 21 | 21 | 87 | 5 | 10 | 25 | 480 | 50 | 389 | 55 | 81 | 4 |
| 22 | 22 | 93 | 6 | 6 | 21 | 571 | 45 | 457 | 50 | 80 | 3 |
| 23 | 23 | 30 | 10 | 0 | 15 | 390 | 35 | 316 | 40 | 81 | 3 |
| 24 | 24 | 83 | 6 | 8 | 23 | 1112 | 48 | 878 | 53 | 79 | 3 |
| 25 | 25 | 87 | 4 | 4 | 19 | 780 | 42 | 601 | 47 | 77 | 3 |

| Hot coil no. | Vicker's hardness (Hv): Plate thickness center average | Vicker's hardness (Hv): Deviation | Charpy impact absorption energy (−20° C.) (J) | Charpy impact absorption energy (−40° C.) (J) | DWTT fracture rate (0° C.) (%) | DWTT fracture rate (−20° C.) (%) | Remarks |
|---|---|---|---|---|---|---|---|
| 1 | 194 | 16 | 290 | 280 | 90 | 80 | Inv. ex. |
| 2 | 199 | 14 | 240 | 230 | 85 | 75 | Inv. ex. |
| 3 | 189 | 13 | 255 | 245 | 85 | 75 | Inv. ex. |
| 4 | 177 | 14 | 240 | 230 | 88 | 78 | Inv. ex. |

TABLE 5-continued

| | | | | | | | |
|---|---|---|---|---|---|---|---|
| 5 | 206 | 11 | 240 | 230 | 92 | 82 | Inv. ex. |
| 6 | 168 | 16 | 260 | 250 | 85 | 75 | Inv. ex. |
| 7 | 164 | 14 | 280 | 270 | 88 | 78 | Inv. ex. |
| 8 | 175 | 16 | 275 | 265 | 100 | 98 | Inv. ex. |
| 9 | 177 | 17 | 270 | 260 | 100 | 96 | Inv. ex. |
| 10 | 195 | 14 | 260 | 250 | 100 | 91 | Inv. ex. |
| 11 | 199 | 13 | 245 | 235 | 100 | 100 | Inv. ex. |
| 12 | 199 | n | 260 | 250 | 100 | 98 | Inv. ex. |
| 13 | 191 | 16 | 280 | 270 | 100 | 97 | Inv. ex. |
| 14 | 206 | 14 | 275 | 265 | 99 | 89 | Inv. ex. |
| 15 | 196 | 19 | 270 | 260 | 100 | 91 | Inv. ex. |
| 16 | 192 | 14 | 260 | 250 | 100 | 90 | Inv. ex. |
| 17 | 211 | 16 | 240 | 230 | 100 | 95 | Inv. ex. |
| 18 | 181 | 14 | 260 | 250 | 100 | 96 | Inv. ex. |
| 19 | 179 | 15 | 270 | 260 | 100 | 98 | Inv. ex. |
| 20 | 188 | 12 | 285 | 275 | 100 | 91 | Inv. ex. |
| 21 | 148 | 16 | 275 | 255 | 100 | 100 | Inv. ex. |
| 22 | 176 | 14 | 280 | 270 | 100 | 100 | Inv. ex. |
| 23 | 120 | 11 | 260 | 250 | 100 | 100 | Comp. ex. |
| 24 | 342 | 15 | no | 100 | 40 | 30 | Comp. ex. |
| 25 | 240 | 13 | 270 | 260 | 85 | 75 | Comp. ex. |

TABLE 6

| Hot coil no. | Steel no. | Plate thickness center: Total of area ratios of bainite and acicular ferrite (%) | Plate thickness center: Effective crystal grain size (μm) | Any two portions Absolute value of A-B (%): Min. | Any two portions Absolute value of A-B (%): Max. | Tensile strength (TS) (MPa): Average | Tensile strength (TS) (MPa): Deviation | Yield strength (MPa): Average | Yield strength (MPa): Deviation | Yield to tensile ratio: Average | Yield to tensile ratio: Deviation |
|---|---|---|---|---|---|---|---|---|---|---|---|
| 26 | 26 | 91 | 4 | 2 | 17 | 626 | 38 | 464 | 48 | 74 | 3 |
| 27 | 27 | 95 | 6 | 8 | 23 | 622 | 48 | 498 | 58 | 60 | 3 |
| 28 | 28 | 94 | 5 | 0 | 15 | 545 | 34 | 5D9 | 44 | 79 | 2 |
| 29 | 29 | 93 | 4 | 6 | 21 | 616 | 45 | 474 | 55 | 77 | 3 |
| 30 | 30 | 84 | 6 | 19 | 32 | 550 | 100 | 412 | 110 | 75 | 7 |
| 31 | 31 | 86 | 4 | 37 | 50 | 683 | 120 | 671 | 130 | 98 | 9 |
| 32 | 32 | 87 | 3 | 21 | 34 | 699 | 110 | 552 | 120 | 79 | 8 |
| 33 | 33 | 90 | 4 | 21 | 34 | 585 | 110 | 456 | 120 | 78 | 8 |
| 34 | 34 | 91 | 5 | 19 | 32 | 654 | 100 | 503 | 110 | 77 | 7 |
| 35 | 35 | 93 | 6 | 41 | 54 | 573 | 130 | 464 | 140 | 81 | 9 |
| 36 | 36 | 85 | 5 | 25 | 35 | 705 | 80 | 556 | 90 | 79 | 6 |
| 37 | 37 | 20 | 10 | 0 | 15 | 291 | 45 | 233 | 55 | 80 | 3 |
| 38 | 38 | 80 | 3 | 23 | 33 | 730 | 40 | 375 | 50 | 51 | 3 |
| 39 | 39 | 82 | 4 | 25 | 35 | 710 | 45 | 464 | 56 | 65 | 3 |
| 40 | 40 | 86 | 6 | 23 | 37 | 750 | 35 | 517 | 45 | 69 | 3 |
| 41 | 41 | 97 | 5 | 25 | 34 | 800 | 50 | 720 | 60 | 90 | 4 |
| 42 | 42 | 85 | 5 | 10 | 25 | 630 | 50 | 492 | 55 | 78 | 4 |
| 43 | 1 | 80 | 13 | 15 | 25 | 620 | 45 | 485 | 50 | 78 | 3 |
| 44 | 1 | 90 | 11 | 13 | 23 | 630 | 40 | 496 | 45 | 79 | 2 |
| 45 | 1 | 100 | 9 | 20 | 40 | 750 | 100 | 580 | 105 | 77 | 10 |
| 46 | 1 | 85 | 15 | 10 | 25 | 640 | 45 | 450 | 50 | 70 | 3 |
| 47 | 1 | 80 | 6 | 25 | 35 | 625 | 90 | 485 | 100 | 78 | 10 |
| 48 | 1 | 85 | 8 | 26 | 40 | 610 | 85 | 467 | 95 | 77 | 7 |
| 49 | 1 | 97 | 9 | 30 | 40 | 700 | 105 | 600 | 115 | 86 | 10 |
| 50 | 1 | 90 | 6 | 32 | 45 | 650 | 95 | 83 | 105 | 13 | 3 |
| 51 | 1 | 90 | 7 | 25 | 29 | 660 | 40 | 550 | 40 | 83 | 4 |

| Hot coil no. | Vicker's hardness (Hv): Plate thickness center average | Vicker's hardness (Hv): Min. | Charpy impact absorption energy (−20° C.) (J) | Charpy impact absorption energy (−40° C.) (J) | DWTT fracture rate (0° C.) (%) | DWTT fracture rate (−20° C.) (%) | Remarks |
|---|---|---|---|---|---|---|---|
| 26 | 193 | 10 | 90 | 80 | 30 | 20 | Comp. ex. |
| 27 | 191 | 10 | 35 | 25 | 39 | 29 | Comp. ex. |
| 28 | 198 | 10 | 40 | 20 | 60 | 50 | Comp. ex. |
| 29 | 189 | 9 | 30 | 20 | 50 | 30 | Comp. ex. |
| 30 | 169 | 8 | 255 | 245 | 100 | 93 | Comp. ex. |
| 31 | 210 | 11 | 275 | 265 | 100 | 91 | Comp. ex. |
| 32 | 215 | 11 | 245 | 235 | 99 | 89 | Comp. ex. |
| 33 | 180 | 9 | 255 | 245 | 95 | 85 | Comp. ex. |
| 34 | 201 | 10 | 130 | 120 | 96 | 86 | Comp. ex. |
| 35 | 176 | 9 | 70 | 60 | 99 | 89 | Comp. ex. |
| 36 | 217 | 11 | 60 | 50 | 80 | 70 | Comp. ex. |

TABLE 6-continued

| | | | | | | | |
|---|---|---|---|---|---|---|---|
| 37 | 90 | 4 | 240 | 230 | 100 | 95 | Comp. ex. |
| 38 | 225 | 11 | 70 | 60 | 75 | 65 | Comp. ex. |
| 39 | 218 | 11 | 40 | 30 | 60 | 50 | Comp. ex. |
| 40 | 231 | 12 | 30 | 20 | 50 | 40 | Comp. ex. |
| 41 | 246 | 12 | 60 | 50 | 65 | 55 | Comp. ex. |
| 42 | 194 | 10 | 250 | 240 | 90 | 85 | Inv. ex. |
| 43 | 191 | 10 | 140 | 130 | 80 | 70 | Comp. ex. |
| 44 | 194 | 20 | 230 | 220 | 90 | 80 | Comp. ex. |
| 45 | 231 | 20 | 120 | 110 | 65 | 55 | Comp. ex. |
| 46 | 197 | 5 | 150 | 140 | 80 | 70 | Comp. ex. |
| 47 | 192 | 15 | 200 | 190 | 80 | 75 | Comp. ex. |
| 48 | 188 | 12 | 180 | 170 | 80 | 70 | Comp. ex. |
| 49 | 215 | 13 | 60 | 50 | 90 | 85 | Comp. ex. |
| 50 | 200 | 13 | 160 | 150 | 80 | 70 | Comp. ex. |
| 51 | 203 | 12 | 100 | 80 | 70 | 60 | Inv. ex. |

As clear from Tables 5 to 6, the invention examples of the Hot Coil Nos. 1 to 17 and 30 to 47 all, even with a plate thickness of 7 to 25 mm, had a total of the area ratios of bainite and acicular ferrite and an effective crystal grain size in the predetermined ranges. As a result, in all of the invention examples, the tensile strength (TS) was 400 to 700 MPa and the deviation in the same was 60 MPa or less. Further, the deviation in the Vicker's hardness was 20 Hv or less. Furthermore, it was confirmed that the Charpy impact absorption energy at −20° C. was 150J or more and the DWTT ductile fracture rate at 0° C. was 85% or more. In particular, when the total of the areas of the bainite and acicular ferrite is 80% or more, it could be confirmed that the Charpy impact absorption energy at −40° C. was 200J or more and the DWTT ductile fracture rate at −20° C. was 85% or more.

On the other hand, the comparative examples of Hot Coil Nos. 18 to 29 have at least one of the total of the area ratios of bainite and acicular ferrite and the effective crystal grain size outside the predetermined range, so the desired strength etc. are not obtained or the deviations in strength etc. are large. This is because the conditions of the rough rolling or the cooling conditions are outside the predetermined ranges. Further, Hot Coil Nos. 48 to 63 have a chemical composition outside the predetermined range, so at least one of the total of the area ratios of bainite and acicular ferrite and effective crystal grain size was outside the predetermined range. As a result, it was confirmed that the desired strength etc. were not obtained or the deviations in strength etc. were large.

INDUSTRIAL APPLICABILITY

As explained above, the hot coil for line pipe use of the present invention is small deviation of ordinary temperature strength and is excellent in low temperature toughness. Therefore, if using the hot coil for line pipe use of the present invention to produce line pipe, line pipe with a high reliability not only at ordinary temperature but also at low temperature can be obtained. Accordingly, the present invention is high in value for industrial utilization.

The invention claimed is:

1. A method of production of hot coil for line pipe use characterized by heating a steel slab which has a chemical composition which contains, by mass %, C: 0.03 to 0.10%,
Si: 0.01 to 0.50%,
Mn: 0.5 to 2.5%,
P: 0.001 to 0.03%,
S: 0.0001 to 0.0030%,
Nb: 0.0001 to 0.2%,
Al: 0.0001 to 0.05%,
Ti: 0.0001 to 0.030%, and
B: 0.0001 to 0.0005% and which has a balance of iron and unavoidable impurities to 1000 to 1250° C., then hot rolling it, during which making a draft ratio in a recrystallization temperature range 1.9 to 4.0 and making the steel plate in the middle of the hot rolling stop at least once between rolling passes in the recrystallization temperature range for 100 to 500 seconds, and cooling the obtained hot rolled steel plate divided between a front stage and a back stage, during which, in the front stage cooling, cooling by a cooling rate of 0.5 to 15° C./sec at a center part of plate thickness of the hot rolled steel plate until a surface temperature of said hot rolled steel plate becomes 600° C. from the cooling start temperature of the front stage, and, in the back stage cooling, cooling by a cooling rate which is faster than the front stage at the center part of plate thickness of the hot rolled steel plate, and coiling the steel plate, after said back stage cooling, at 450 to 600° C.

2. The method of production of hot coil for line pipe use characterized by heating a steel slab which has a chemical composition which contains, by mass, C: 0.03 to 0.10%,
Si: 0.01 to 0.50%,
Mn: 0.5 to 2.5%,
P: 0.001 to 0.03%,
S: 0.0001 to 0.0030%,
Nb: 0.0001 to 0.2%,
Al: 0.0001 to 0.05%,
Ti: 0.0001 to 0.030%, and
B: 0.0001 to 0.0005% and said steel slab further containing one or more of, by mass %, Cu: 0.01 to 0.5%,
Ni: 0.01 to 1.0%,
Cr: 0.01 to 1.0%,
Mo: 0.01 to 1.0%,
V: 0.001 to 0.10%,
W: 0.0001 to 0.5%,
Zr: 0.0001 to 0.050%
Ta: 0.0001 to 0.050%
Mg: 0.0001 to 0.010%,
Ca: 0.0001 to 0.005%,
REM: 0.0001 to 0.005%,
Y: 0.0001 to 0.005%,
Hf: 0.0001 to 0.005% and
Re: 0.0001 to 0.005% and which has a balance of iron and unavoidable impurities to 1000 to 1250° C., then hot rolling it, during which making a draft ratio in a recrystallization temperature range 1.9 to 4.0 and making the steel plate in the middle of the hot rolling stop at least once between rolling passes in the recrystallization temperature range for 100 to 500 seconds, and cooling the obtained hot rolled steel plate divided between a front stage and a back stage, during which, in the front stage cooling, cooling by a cooling rate of 0.5 to 15° C./sec at a center part of plate thickness of the hot rolled steel plate until a surface temperature of said hot rolled steel plate becomes 600° C. from the cooling start temperature of the front stage, and, in the back stage cooling, cooling by a cooling rate which is faster than the front stage at the center part of plate thickness of the hot rolled steel plate, and coiling the steel plate, after said back stage cooling, at 450 to 600° C.

3. The method of production of hot coil for line pipe use as set forth in claim 1 or 2 characterized by hot rolling by a draft ratio in a non-recrystallization temperature range of 2.5 to 4.0.

4. The method of production of hot coil for line pipe use as set forth in claim 1 or 2 characterized by starting said front stage cooling from a 800 to 850° C. temperature range and cooling through the 800 to 600° C. temperature range by a cooling rate at the center part of plate thickness of 0.5 to 10° C./sec.

5. The method of production of hot coil for line pipe use as set forth in claim 3 characterized by starting said front stage cooling from a 800 to 850° C. temperature range and cooling through the 800 to 600° C. temperature range by a cooling rate at the center part of plate thickness of 0.5 to 10° C./sec.

* * * * *